US005350307A

United States Patent [19]

Takagishi et al.

[11] Patent Number: 5,350,307

[45] Date of Patent: Sep. 27, 1994

[54] CONNECTOR FOR PRINTED CIRCUIT BOARD

[75] Inventors: Takashi Takagishi; Nobuhiko Suzuki; Akira Kato, all of Shizuoka, Japan

[73] Assignee: Yazaki Corporation, Tokyo, Japan

[21] Appl. No.: 868,766

[22] Filed: Apr. 14, 1992

[30] Foreign Application Priority Data

Apr. 15, 1991 [JP] Japan ..... 3-025041[U]

[51] Int. Cl.[5] ..... H01R 9/09

[52] U.S. Cl. ..... 439/79; 439/33

[58] Field of Search ..... 439/78, 79, 80, 733, 439/83, 701, 32, 33

[56] References Cited

U.S. PATENT DOCUMENTS

| | | | |
|---|---|---|---|
| 4,469,387 | 9/1984 | McHugh | 439/79 X |
| 4,722,691 | 2/1988 | Gladd et al. | 439/79 |
| 5,037,334 | 8/1991 | Viselli et al. | 439/79 X |
| 5,104,326 | 4/1992 | Smith et al. | 439/79 X |

FOREIGN PATENT DOCUMENTS 982080 7/1985 Japan .

*Primary Examiner*—Khiem Nguyen

*Attorney, Agent, or Firm*—Venable, Baetjer, Howard & Civiletti

[57] ABSTRACT

A connector for a printed circuit board, having a terminal guide for guiding lead terminals, improved to suppress cracking or separation caused by a temperature change in the regions where the lead terminals are soldered to the printed circuit board. The connector has a housing having side walls on both longitudinal ends thereof, the side walls being provided with engaging grooves. The housing mounts a plurality of lead terminals which are led therefrom. The connector also has a terminal guide which is a substantially tabular member made from an insulating material provided on both longitudinal ends thereof with projections for engagement with the engaging grooves of the housing. The terminal guide has a plurality of lead terminal insertion holes formed at the same pitch as the lead terminals so as to receive these lead terminals. At least one stress relieving portion in the form of a slit or an elongated slot or aperture is formed in the terminal guide so as to localize any thermal expansion or contraction of the terminal guide occurring in the longitudinal direction thereof.

2 Claims, 2 Drawing Sheets

CONNECTOR FOR PRINTED CIRCUIT BOARD

BACKGROUND OF THE INVENTION

1. Field of the Invention

The present invention relates to a connector for a printed circuit board and, more particularly, to a terminal guide of lead terminals used in a right-angle type connector for a printed circuit board.

2. Description of the Related Arts

There are two types of connectors for printed circuit boards: straight-type connectors in which lead terminals are led straight in order to mount the connector perpendicularly to the printed circuit board and right-angle type connector in which lead terminals are bent at a right angle to enable the connector to be mounted in parallel with the printed circuit board.

A right-angle type connector for printed circuit boards has a problem in that, when the number of the lead terminals is large, it is difficult to maintain the pitch or spacing of the lead terminals in conformity with the pitch of the holes which are formed in the printed circuit board to receive the lead terminals. This problem causes an impediment to the use of an automatic assembly system which is becoming popular in recent years. Whether an automatic assembly system can be adopted significantly depends on whether the lead terminals can possibly be arranged at such a small pitch is possible.

Japanese Patent Laid-Open No. 60-98280 shows an example of such a known right-angle type connector for printed circuit boards. The connector has a housing which is provided at both ends thereof with protruding tabs and notches having groove are formed in the housing at the inner side of the protruding tabs. Orthogonally-bent terminals are mounted on the housing. A terminal guide is provided that has lead terminal insertion holes formed at a pitch corresponding to the pitch of the lead terminals. Projections for engagement with the above-mentioned grooves in the housing are formed on both ends of the terminal guide.

In use, after the lead terminals are mounted on the housing, terminals are inserted into the lead terminal insertion holes in the terminal guide. Then, both ends of the terminal guides are put into engagement with the notches near the tabs and the projections are resiliently engaged with the grooves, thus holding the leads correctly at a predetermined pitch.

The following problem arises when the lead terminals are mounted by soldering their ends to the printed circuit board. For instance, a glass epoxy resin having a thermal expansion coefficient of 0.1% is used as the material of the printed circuit board while the material of the terminal guide is,for example, a reinforced polyethylene terephthalate having a thermal expansion coefficient of 0.3%, Consequently, if heat is applied after independent soldering, stress is concentrated to the ends of the lead terminals and the root portions of the solder, due to difference in the thermal expansion, i.e., due to difference in the thermal expansion coefficient between the printed circuit board and the terminal guide. Consequently, cracks or separations appear at the soldered portion, resulting in an inferior contact.

In another assembly method, ends of the lead terminals are automatically soldered to the printed circuit board and then the assembly is cooled down to the normal temperature. Stress concentration also takes place in this method in the regions between the ends of the lead terminals and the soldered portions of the printed circuit board, due to a difference in the amount of thermal contraction caused by the difference in the material. Cracks or separations also take place in this case, with the result that the reliability of electrical connection is impaired.

SUMMARY OF THE INVENTION

In view of the problems of the known art described above, an object of the present invention is to provide a printed circuit board connector having a terminal guide, which is improved to eliminate any crack or separation which, hitherto, tends to occur in the soldered ends of lead terminals due to a change in temperature.

To this end, according to one aspect of the present invention, there is provided a connector for a printed circuit board, comprising: a housing; a plurality of lead terminals mounted in and led from the housing; and a terminal guide mounted in the housing and having a plurality of lead terminal insertion holes for receiving the lead terminals, the terminal guide having at least one stress relieving portion for absorbing thermal expansion or contraction occurring in the longitudinal direction of the terminal guide.

The connector for printed circuit board in accordance with the present invention, by virtue of the features set forth above, is free from the problem of cracking or separation which is caused by a change in temperature.

The above and other objects,features and advantages of the present invention will become clear from the following description of the preferred embodiments when the same is read in conjunction with the accompanying drawings.

DESCRIPTION OF THE PREFERRED EMBODIMENTS

Figure 1:
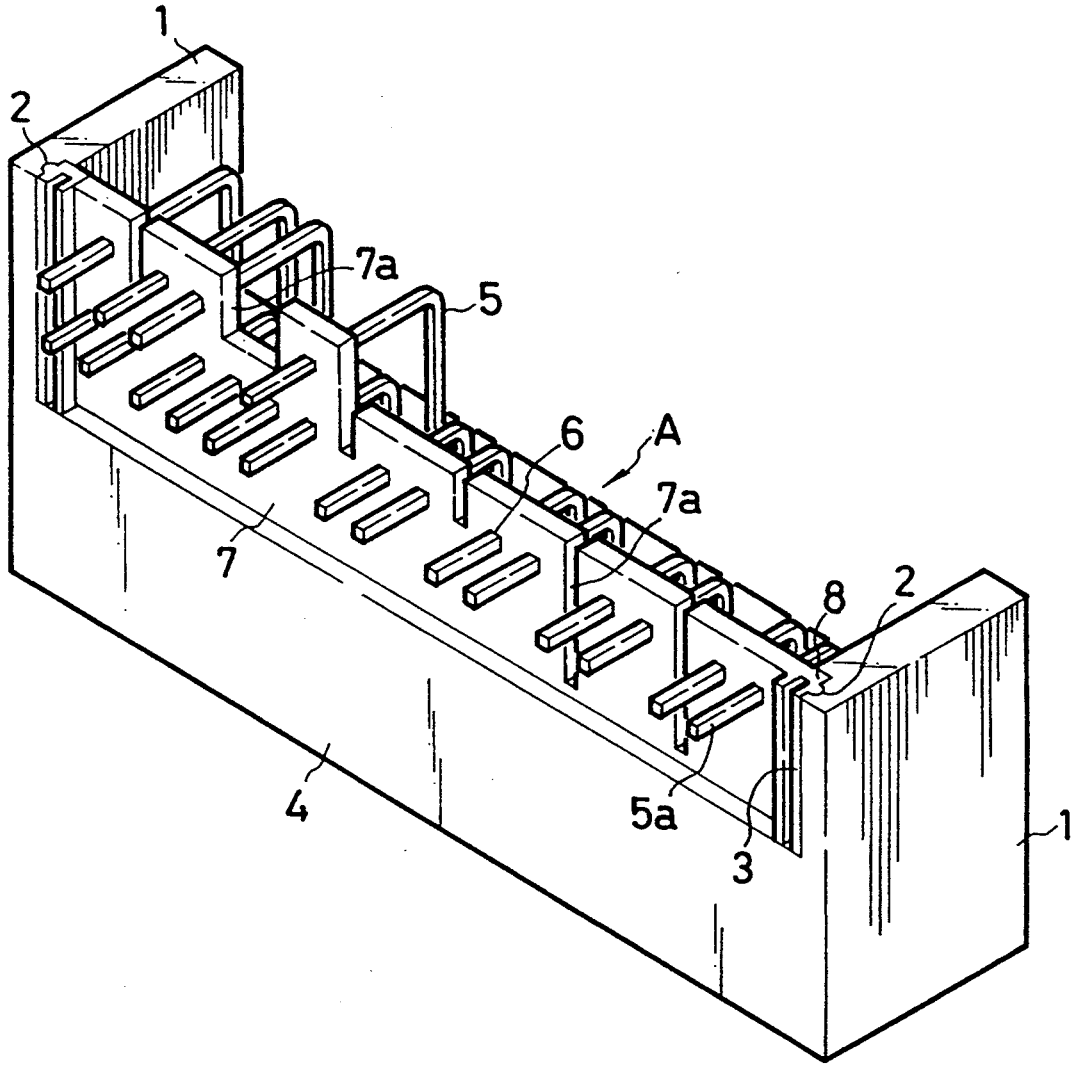
FIG. 1 is a perspective view of a first embodiment of the connector in accordance with the present invention.

Referring to FIG. 1, there is shown a connector A of the present invention, having a terminal guide 7 mounted thereon. The connector A has a housing 4 which is formed of a synthetic resin and which is provided at its both ends with side walls 1, 1. Each side wall 1 is notched or stepped at its inner side as at 3, and a groove 2 is formed in the stepped surface. A multiplicity of orthogonally-bent lead terminals 5 are mounted on the housing 4. The terminal guide 7 is formed of a tabular member made of an insulating synthetic resin, and is provided with slits *7a* which serve as stress relieving portions for relieving thermal stress caused by thermal expansion or contraction. The slits *7a* are formed to extend substantially perpendicularly to the longitudinal axis of the terminal guide 7, so as to open in one longitudinal edge of the terminal guide 7. Lead terminal insertion holes 6 for receiving lead terminals 5 are formed in the terminal guide 7 at a pitch corresponding to the pitch of the lead terminals 5. Projections 8 for engagement with the grooves 2 in the housing 4 are formed on both ends of the terminal guide 7.

The process of manufacturing the connector is as follows. The housing 4 and the terminal guide 7 are fabricated separately. After the fabrication of the housing 4, ends 5*a* of the lead terminals 5 are inserted into corresponding lead terminal insertion holes 6 in the terminal guide 7,and the terminal guide 7 is fixed in the housing 4 with the projections 8, 8 on both ends of the terminal guide 7 received in the grooves 2 formed in the housing 4. During the assembly of the housing 4, the ends 5*a* of the lead terminals 5 may be arranged irregularly. However, as a result of insertion into the lead terminal holes 6, the ends 5*a* of the lead terminals 5 are set to correct positions so as to be arrayed at a constant pitch. Subsequently, the ends 5*a* of the lead terminals are inserted into insertion holes (not shown) formed in the printed circuit board 10 and are soldered thereto, thus completing connection of the lead terminals 5 to the printed circuit board 10.

Figure 2:
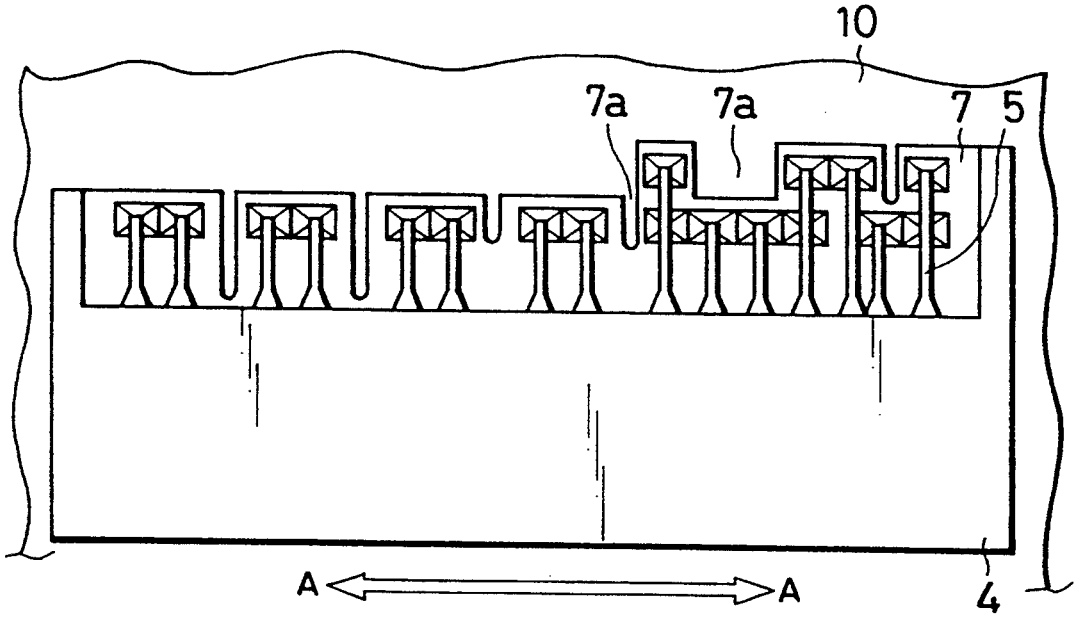
FIG. 2 is a front elevational view of the connector connected to a printed circuit board.

The amount of thermal expansion or contraction of a member is generally proportional to the length of the member. This means that the thermal stress due to expansion or contraction is dominant in the direction of the double-headed arrow A—A in FIG. 2. In order to relieve such thermal stress due to expansion or contraction, therefore, it suffices to provide the stress relieving slits 7*a* in such a manner as to absorb any thermal expansion or contraction occurring in the longitudinal direction of the terminal guide 7. Namely, at least one stress relieving slit 7*a* is formed in the terminal guide 7 at a position near insertion holes 6 for receiving the lead terminals, although the embodiment shown in FIGS. 1 and 2 have a plurality of such stress relieving slits 7*a*. Such a stress relieving slit or slits form a discontinuity of the terminal guide 7 in the longitudinal direction thereof, so as to localize expansion or contraction caused by a change in the temperature. This arrangement remarkably suppressed cracking or separation in the soldered region between the ends 5*a* of the lead terminals 5 and the printed circuit board 10, which tend to occur in the conventional connectors due to a difference in the amount of thermal expansion between the housing 4 and the terminal guide 7.

Figure 3:
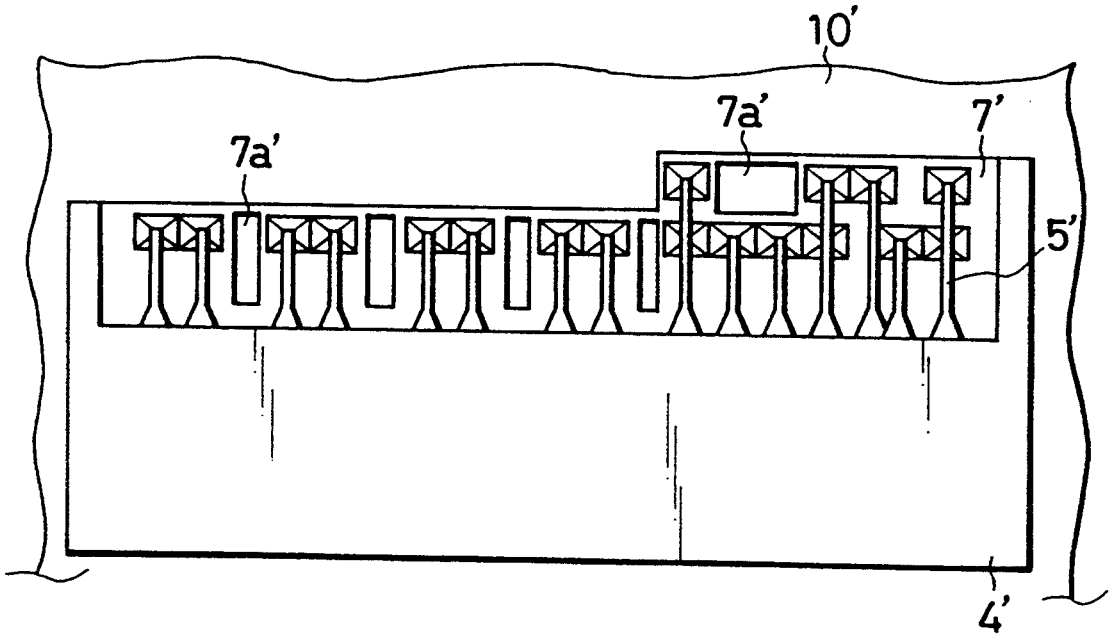
FIG. 3 is a front elevational view of another embodiment of the connector in accordance with the present invention.

FIG. 3 shows another embodiment of the present invention in which, in place of the slits 7*a* in the first embodiment, elongated slots or apertures 7*a'* are formed in the terminal guide 7'. Although FIG. 3 shows a plurality of such elongated slots or apertures 7*a'*, the number of the elongated slots or apertures is only illustrative and at least one such elongated slot or aperture may suffice in some cases. Other portions are materially the same as those of the first embodiment.

The second embodiment offers substantially the same advantages as the first embodiment. Namely, the elongated slots or apertures 7*a'* serve as stress relieving portions which effectively absorb and localize thermal expansion or contraction, thereby minimizing thermal stress and, therefore, suppressing the tendency of cracking or separation which otherwise may be caused due to concentration of stress to the regions where the ends 5*a'* of the lead terminals 5' are soldered to the printed circuit board 10'.

What is claimed is:

1. A connector for a printed circuit board, comprising:

a housing;

an elongated terminal guide mounted in said housing and having a plurality of lead terminal insertion holes spaced longitudinally apart for receiving lead terminals, and a plurality of stress relieving openings disposed between said longitudinally adjacent lead terminal insertion holes for absorbing thermal expansion or contraction of said terminal guide in a longitudinal direction; and a plurality of lead terminals mounted in respective ones of said lead terminal insertion holes;

wherein said stress relieving openings comprise slits formed in said terminal guide, said slits each having an opening in a longitudinal edge of said terminal guide.

2. A connector for a primed circuit board, comprising:

a housing having two opposing side walls that are provided with engaging grooves;

an elongated terminal guide mounted in said housing and having a plurality of lead terminal insertion holes spaced longitudinally apart for receiving lead terminals, and a plurality of projections that engage the engaging grooves of said housing; and a plurality of lead terminals mounted in respective ones of said lead terminal insertion holes, said lead terminals being orthogonally bent;

wherein said terminal guide is made of an insulating synthetic resin and is provided with at least one stress relieving opening disposed between two longitudinally adjacent ones of said lead terminal insertion holes for absorbing thermal expansion or contraction of said terminal guide in a longitudinal direction;

wherein said at least one stress relieving opening one stress relieving slit, said at least one stress relieving slit each having an opening in a longitudinal edge of said terminal guide.

* * * * *